United States Patent [19]

Gitman

[11] Patent Number: 5,042,964

[45] Date of Patent: Aug. 27, 1991

[54] FLASH SMELTING FURNACE

[75] Inventor: Gregory M. Gitman, Duluth, Ga.

[73] Assignee: American Combustion, Inc., Norcross, Ga.

[21] Appl. No.: 464,613

[22] Filed: Jan. 2, 1990

Related U.S. Application Data

[63] Continuation-in-part of Ser. No. 199,248, May 26, 1988, Pat. No. 4,890,562.

[51] Int. Cl.[5] ..... F27B 14/00

[52] U.S. Cl. ..... 432/13; 110/236; 266/44; 266/188; 266/222; 266/267; 431/284; 432/196

[58] Field of Search ..... 432/13, 120, 136, 196; 266/186, 187, 188, 222, 267, 44, 172; 110/190, 236, 260, 261, 262; 431/283, 284, 285

[56] References Cited

U.S. PATENT DOCUMENTS

| | | | |
|---|---|---|---|
| 4,249,722 | 2/1981 | Jaquay | 266/188 X |
| 4,622,007 | 11/1986 | Gitman | 432/13 |
| 4,824,362 | 4/1989 | Kimura et al. | 432/13 |

*Primary Examiner*—Edward G. Favors
*Attorney, Agent, or Firm*—Needle & Rosenberg

[57] ABSTRACT

A method and corresponding apparatus for improving the control and efficiency of a combustion reaction in a flash smelting furnace, having the steps of mixing a first oxidizing gas having a first oxygen concentration with solid particles consisting of at least one combustible component and at least one incombustible component, directing the mixture of solid particles and said first oxidizing gas into a combustion chamber of the flash smelting furnace, burning the mixture of solid particles and oxidizing gas in a first flame portion to provide for the smelting of the solid particles, directing an auxiliary fuel into the combustion chamber to surround said first flame portion, directing a second oxidizing gas having a second oxygen concentration into the combustion chamber to surround the first flame portion and mix with the auxiliary fuel, burning the auxiliary fuel and the second oxidizing gas to create a second flame portion surrounding the first flame portion, controlling the flow of the first and second oxidizing gases and the auxiliary fuel to provide a temperature gradient between the first flame portion and the second flame portion for maintaining a desired temperature of the particles leaving the flame envelope during the first stage of smelting, accumulating treated material downstream of said flame envelope, and further directing a stream of additional oxidizing gas to oxidize at least a fraction of combustible components left inside the accumulated material.

22 Claims, 3 Drawing Sheets

FLASH SMELTING FURNACE

This is a continuation-in-part of U.S. patent application No. 07/199,248 filed on May 26, 1988 U.S. Pat. No. 4,890,562.

BACKGROUND OF THE INVENTION

The present invention relates to an apparatus and method of flash smelting. More particularly, the invention relates to a method of controllable oxidation of the combustible components of dispersible particles in a smelting apparatus to provide for improved control over the heat release and temperature distribution during the flash smelting process.

Flash smelting furnaces are used in the extraction of metals to alter the physical and chemical properties of solid ore particles or concentrates to allow separation of their components. The particles are partially or completely melted to change their physical properties and their combustible components are partially or completely oxidized to change their chemical properties. When utilized in a primary metal industry, a flash smelting process extracts a metal, such as copper, from its sulfur-containing ore by passing finely ground ore or concentrates through a high-temperature flame, which melts the concentrates and oxidizes the sulfur. The molten matte is then separated from the molten slag. Frequently, additional fluxing material, such as silica, is mixed with the ore particles prior to their introduction into the flash furnace.

An ore is suitable for a flash smelting process if the energy given off by the oxidation of the combustible components satisfies the sustained high-temperature requirements of the process. Thus, it is desirable to burn ores rich in sulfur, such as copper, in a highly concentrated oxygen stream, such as pure oxygen or oxygen-enriched air, because a major fraction of the heat utilized for flash smelting is generated in situ by the exothermic oxidation reactions. This flash smelting process allows for a significant reduction in the amount of auxiliary energy necessary to smelt the ore compared to reverberatory type furnaces.

Because sulfur sublimates at a very low temperature, it is easy to oxidize gaseous sulfur during the limited time available inside the flame. However, a substantial sulfur content of the particles is essential for conducting the flash smelting process.

The efficiency and stability of a flash smelting process depends in part on the amount of heat being released and transferred to the particles within the flash burner flame envelope prior to their accumulation in the molten bath. This amount, in turn, depends in part on the rate that heat is released from the oxidation reactions occurring in the flash burner flame envelope. When the amount of heat being transferred to the particles, while they are resident in the flash burner flame envelope, decreases, the average temperature of particles heated in the flame decreases. The resulting lower molten bath temperature, in the case of copper ore smelting, reduces the rate of reaction inside the melt, slows the rate of separation of the matte from the slag, and produces deposits of solidified magnetite slag within the furnace. This slag build-up contributes to a further deterioration of the heat transfer properties within the furnace. Eventually, if this cycle continues, the smelting process must be interrupted and the furnace cleaned.

Thus, to prevent unnecessary interruptions in the continuous flash smelting process, the stability of the process must be maintained. This stability can be challenged by reduced ore concentrate feed rates when the concentrate feed system fails, by deviations in the physical or chemical properties of the concentrates, or by an uneven oxidizing gas flow. There have been many attempts to solve this problem.

Some flash smelting furnaces provide for injection of coke with the ore concentrates along with additional oxygen flow to introduce additional fuel and oxidizer into the flame envelope during such upset conditions. Unfortunately, this procedure typically results in the discharge of excessive carbon monoxide and soot into the flue gas treatment train because of the short retention time available for the carbon particles to be oxidized in the flame envelope.

Other smelting furnaces employ additional burners to heat the molten bath and the flash smelting furnace interior. Such use of auxiliary burners enhances the process performance by reducing the dependency of the process on the energy released within the flame envelope, especially when the smelting process is temporarily interrupted by failures upstream or downstream from the smelting furnace. Unfortunately, the use of auxiliary burners does not contribute directly to the heating and melting of the solid particles inside the flash burner flame envelope. Furthermore, the use of auxiliary burners does not control the flash burner flame temperature and, therefore, does not control the amount of heat lost from the flash burner flame to the furnace environment. Therefore, the advantage of the these auxiliary burners is limited to the partial maintenance of the overall furnace interior temperature. This auxiliary energy input does not have a substantial effect on the processes taking place within the flash burner flame envelope.

Although more sulfur in the ore concentrates could be oxidized to increase the heat transferred to the solid particles within the flame envelope, excessive oxidation of the sulfur results in reduced concentrations of sulfur in the matte. This lowered concentration can create a heat deficiency when the matte is oxidized in the converter. The use of carbon particles as an auxiliary fuel is capable of only marginally reducing the share of heat needed from sulfur oxidation inside of the flash smelting burner.

Therefore, a need exists for an improved flash smelting method and apparatus to maintain better control over the temperature distribution inside the flash flame burner envelope by use of an auxiliary fuel capable of rapid oxidation inside the flame envelope of the flash burner. Furthermore, there is a need for a method and apparatus that provides improved control over the combustion reactions occurring and the heat transfer properties of the flash burner flame envelope.

The use of carbon-bearing particles as an auxiliary fuel, introduced by mixing with concentrates, is limited because of the relatively slow rate of carbon oxidation compared to sulfur inside the flash burner flame. For solid dispersible material containing carbon as a major or sole combustible component, the use of existing flash smelting processes cannot be effectively implemented due to a limited rate of carbon oxidation inside the flash burner flame. Because of the difficulties inherent in flash smelting carbon-bearing solids, there also exists a need for a method and apparatus that efficiently flash smelts these solids with the use of an auxiliary fuel that can be easily oxidized inside the flash burner flame envelope.

The use of an existing flash smelting process cannot be recommended to thermally decontaminate carbon-bearing dispersible materials containing a hazardous component. The main reason for the non-suitability of an existing flash smelting apparatus for thermal decontamination purposes is the possibility of incomplete decontamination and leachability of hazardous components from the solid residue generated in the flash smelting chamber. However, many hazardous solid wastes having substantial carbon and/or sulfur content may be converted, at least partially, into melt using the flash smelting method. Incineration of cyanide contaminated spent pot liner from the primary aluminum industry is one such example. This waste has typically more than 30% of carbon and should be converted to unleachable slag to become environmentally safe. Therefore, there exists a need for a flash incinerating method and apparatus capable of converting carbon and/or sulfur-bearing wastes into environmentally safe slag and environmentally safe exhaust gases.

SUMMARY OF THE INVENTION

Figure 1:
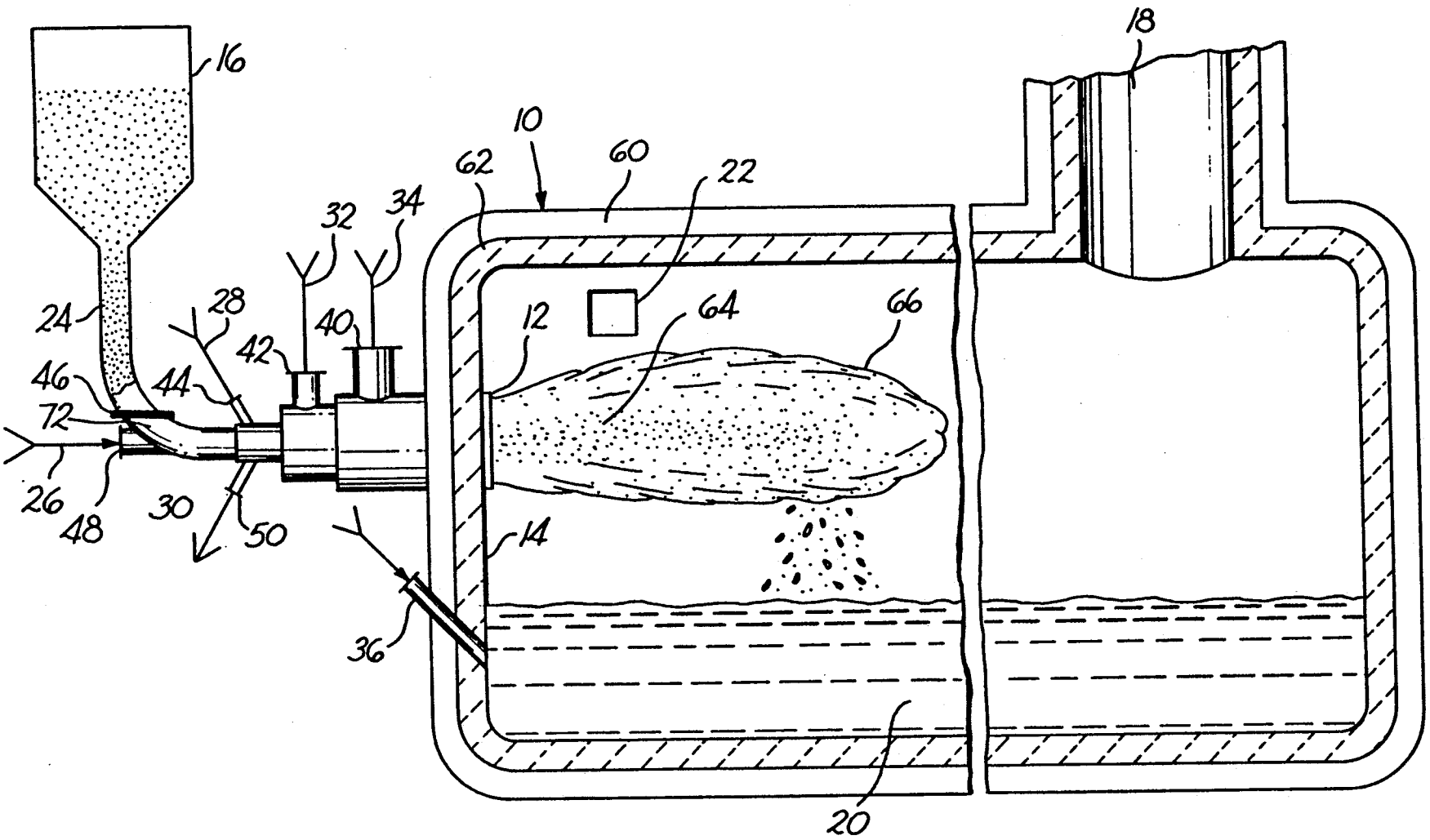
FIGS. 1 and 2 are cross-sectional views through the center of a flash burner illustrating a first embodiment of the present invention.

This invention relates to a smelting process and apparatus that provides improved control over the combustion reactions that occur in the flash flame burner envelope and also inside the molten bath of the material being smelted inside the flash smelting apparatus. This process and apparatus utilizes a flash burner that directs fluid auxiliary fuel and oxidizing gas around the periphery of the central reaction zone of the flash flame envelope and provides for an improved structure of the flame envelope. This improved flame structure provides for insulation of the central reaction of the flame envelope from the chilling effect of the furnace interior and increases the amount of heat available to melt the ore concentrates within the flame envelope. The invention further provides a method and apparatus for flash the smelting of carbon-bearing solid particles or other pumpable material containing a combustible component whose residence time in the flame of conventional flash smelting furnaces is too short to accomplish the necessary heat release inside of the flame envelope to maintain stable flash smelting processes. In addition to providing an improved flash flame envelope, the new flash furnace may employ an additional oxidizing gas directed toward the molten pool to provide the necessary level of oxidation of material being smelted and a desired melt quality. When applied to smelting and thermal decontamination of hazardous wastes, this invention provides for converting hazardous dispersible material into gaseous exhaust and non-hazardous slag.

The invention utilizes auxiliary fuel such as natural gas, propane, oil, or others capable of rapid oxidation inside the flash smelting flame envelope.

An object of this invention is to provide an improved method and apparatus to maintain and control the temperature within the flash flame burner envelope in the flash smelting or high temperature melting of solid particles. Furthermore, this invention provides for improved control over the combustion reactions occurring in the flash flame burner envelope and the heat transfer properties of the envelope within the interior of the furnace. Additionally, an object of this invention is to prevent the build-up of solified slag within a flash smelting furnace by maintaining stable operating conditions despite deviations in the flow of ore particles, in the physical or chemical properties of the particles, or in the oxidizing gas flow. A further object of this invention is to provide a method and apparatus for the flash smelting of carbon-bearing solids or other dispersibles materials whose residence time in the flash flame burner envelope of conventional furnaces is too short to accomplish melting.

Another objective of this invention is to provide a hazardous waste incineration method and apparatus capable of converting dispensable waste into gaseous products and nonhazardous slag.

DETAILED DESCRIPTION OF THE INVENTION

The preferred embodiments of the present invention are now described with reference to the drawings in which like numbers indicate like parts throughout the views.

Figure 2:
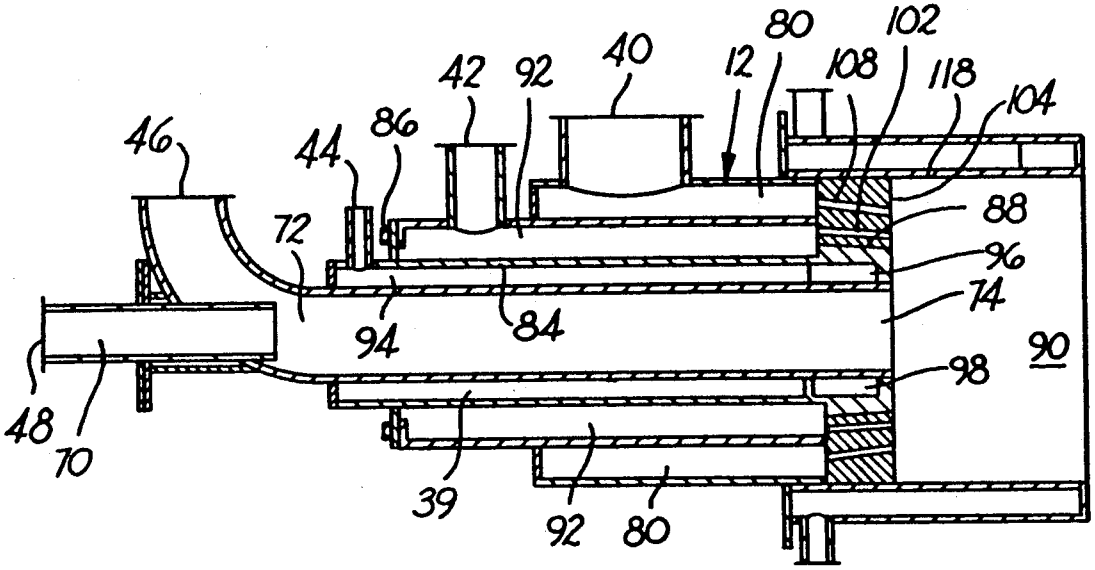

FIGS. 1 and 2 show a first embodiment of the flash smelting apparatus of the present invention, which includes a flash burner 12, a smelting furnace 10, and a concentrate feed tank 16.

The feed tank 16 contains solid particles from an outside source and controllably delivers the particles into the flash burner particles inlet 46 through a funnel-shaped bottom portion and a particles supply line 24.

The burner 12 is preferably made out of steel and includes a main burner conduit 72 receivably attached at a first end to the flash burner particles inlet 46 and deliverably attached at an opposite end to the smelting furnace 10 through nozzle 74 consisting of one or more discharge openings (as shown in FIG. 2). A first high pressure oxidizing gas is controllably delivered from a first oxidizing gas supply conduit 26 from an outside source (not shown) through a first oxidizing gas inlet 48 into the first oxidizing gas conduit 70. The first oxidizing gas is further directed from the conduit 70 into the main burner conduit 72, travels through the main burner conduit 72, and discharges through the central discharge opening 74 into a central reaction zone 64 of the flame envelope 66 formed inside of interior of the smelting furnace 10. The carrier gas may be oxygen, an air-oxygen mixture, compressed air, or other high pressure gas containing oxygen.

A fluid-cooled conduit 84 is provided for supplying a cooling liquid to a burner block 104. The conduit 84 is attached to a cooling fluid inlet 44, through which cooling fluids such as water enter from a cooling fluid conduit 28 into a delivering channel 94 of conduit communicating with a fluid cooled jacket 96, 98 attached to the burner block 104.

The fluid cooled jacket 96, 98 is also communicating with a cooling fluid discharging channel 39 of water-cooled conduit 84. The discharging channel 39 is attached to the cooling fluid outlet 50 (shown in FIG. 1), through which the cooling fluid is discharged from the channel 39. The jacket 98 prevents the burner block 104 from overheating during the combustion process.

An auxiliary fuel conduit 92 is provided for directing an auxiliary fuel from an auxiliary gas supply conduit 32 from an outside source (not shown) through an auxiliary fuel inlet 42 to the smelting furnace 10 through a plurality of fuel channels 102 provided in the burner block 104. The auxiliary fuel conduit 92 is located above fluid-cooled conduit 84 and in parallel with the axis of main burner conduit 72. The fuel channels 102 are spaced symmetrically to surround the central discharge opening 74 in the burner block 104. Preferably the fuel channels 102 are in parallel to the axis of the main burner conduit 72 to direct streams of auxiliary fuel in flame envelope 66 of the burner 12 and at least partially toward a peripheral zone 68 of the flame envelope.

A second oxidizing gas conduit 80 is also provided for directing a second oxidizing gas, preferably pure oxygen, oxygen-enriched air, or air which enters from a second oxidizing gas supply line 34 through a second oxidizing gas inlet 40, toward and into the flame envelope 66. The second oxidizing gas conduit 80 is located above the auxiliary gas conduit 92 and is in parallel with the axis of the main burner conduit 72. The second oxidizing gas is discharged from the second oxidizing gas conduit 80 into the flame envelope 66 through a plurality of gas channels 108 which are spaced symmetrically around the central discharge opening 74 in the burner block 104. Preferably, gas channels 108 are oriented to direct the streams of the second oxidizing gas toward the peripheral zone 68 of the flame envelope 66 center point directed toward the exterior of the smelting furnace 10.

The smelting furnace 10 may be of conventional design, preferably having a fluid-cooled section 60 and a refractory section 62 surrounding the furnace wall 14. An exhaust opening 18 connects the interior of the smelting furnace to an outside collection means for flue gases (not shown). Furthermore, additional oxidizing gas may be directed through the furnace wall 14 toward molten pool 20 in the furnace through optional injection means 36. The smelting furnace 10 also may be equipped with charging opening 22 to charge solids that are similar or different in size and chemistry to those being charged through the flash burner 12. Optionally, an auxiliary fluid-cooled block 118 may be installed through furnace wall 14 creating a combustion chamber 90 at the front of the burner block 104. Overheating of the burner block 104 may be prevented by use of the fluid-cooling jacket 84 alone or in conjunction with heat extraction accomplished through contact with the fluid-cooled block 118 or with fluid-cooled section 60 of furnace wall 14.

Figure 3:
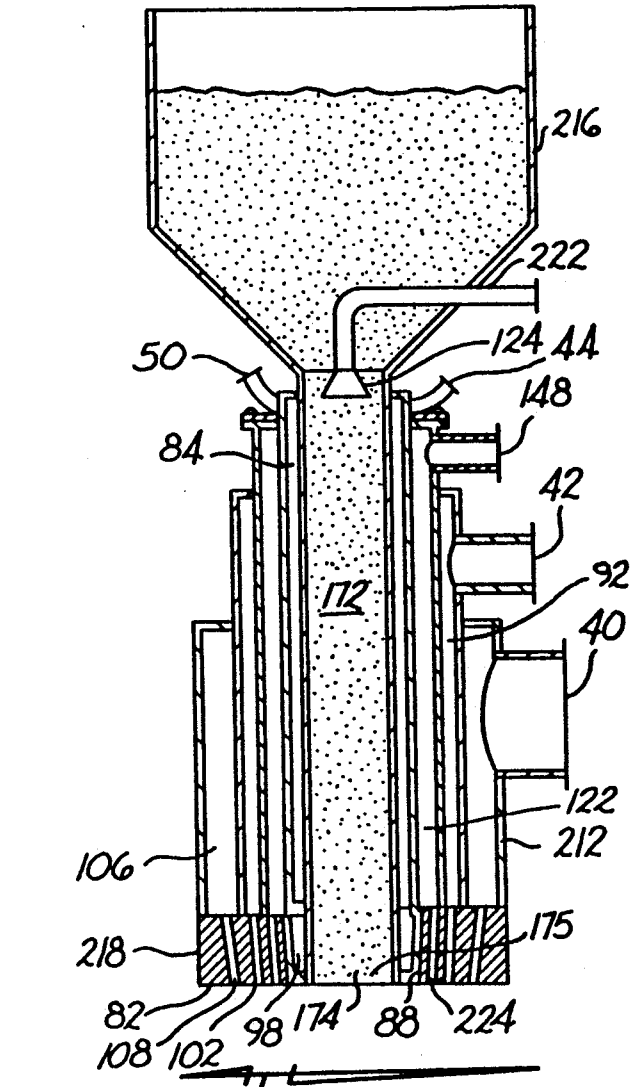
FIGS. 3 and 4 are cross-sectional views through the center of a flash burner illustrating a second embodiment of the present invention.
Figure 4:
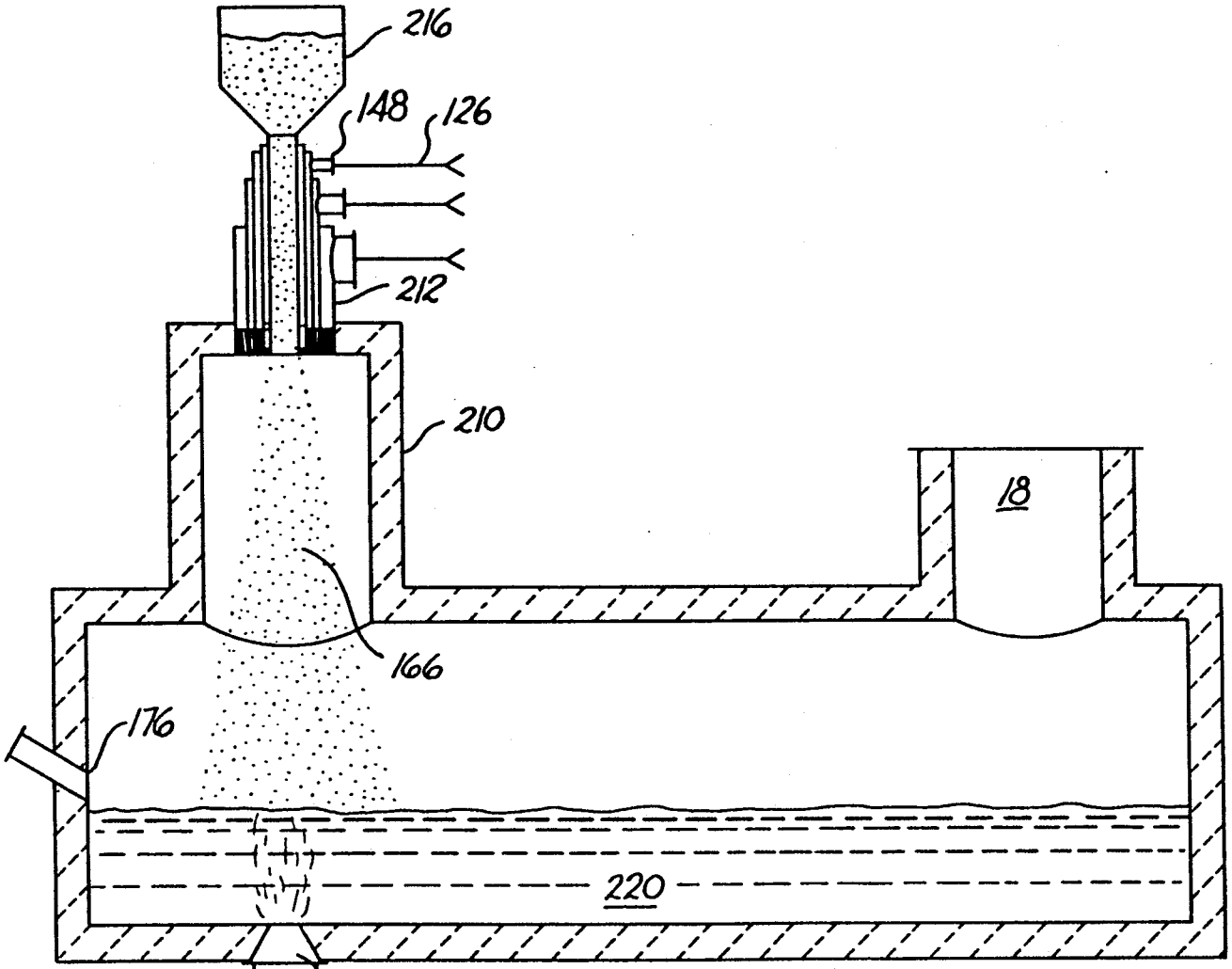

FIG. 3 and FIG. 4 show a second embodiment of a flash smelting furnace and burner apparatus 112. The burner apparatus embodiment is similar to the previous embodiment shown in FIGS. 1 and 2 except for the way the first oxidizing gas and solid particles are introduced to the burner, are transported throughout the burner, and introduced into the flame envelope.

In the second embodiment of the flash smelting furnace 210, the flash burner 212 is located on the roof of the furnace and is directed down so that solid particles may travel from feed tank 216 with the force of gravity throughout the main burner conduit 172 and further through discharge nozzle 174 consisting of one or more discharge openings 175 directing said solid particles toward the flash burner flame envelope 166.

The first oxidizing gas, such as oxygen, oxygen-enriched air, or other gas containing oxygen, is directed from the first oxidizing gas supply conduit 126 connected to the outside source (not shown) through a first oxidizing gas inlet 148 into the burner block 218 through a plurality of first oxidizing gas channels 224 located in the burner block 218.

The first oxidizing gas channels 224 are preferably spaced symmetrically and at least part of channels 224 are preferably angularly oriented to direct a stream of first oxidizing gas toward the central axis of the flash burner flame envelope. Optionally, flash smelting furnace 210 may include injection means 176 for injection of $H_2O$ mist or steam into the smelting furnace interior. Such injection may be used, for example, to provide the hydrogen for converting Cl into HCl when a high level of Cl is present in charged material. Also as an option, additional oxidizing gas such as air, oxygen or oxygen-enriched air may be injected through injection means 164 to contact with the molten bath 220 to provide for further oxidation of the combustible components remaining in the melt.

During a typical flash smelting operation of the first embodiment, solid particles, such as sulfur-rich copper concentrates or ground particles of contaminated spent pot lining from a primary aluminum industry, are fed from feed tank 16 to the main burner conduit 72. A controllable flow of a first oxidizing gas is simultaneously directed along the first oxidizing gas conduit 70 and into the main burner conduit 72. The flow rate of the oxidizing gas can be adjusted by an electronic flow measuring means to maintain desired flow proportions. The first oxidizing gas mixes with the solid particles along the initial portion of the main burner conduit 72 and further forces the particles to move along the main burner conduit 72 toward the central discharge opening 74. This solid-gas mixture, when ignited, creates a central reaction zone 64 in the flash burner flame envelope 66 where oxidation of combustible components of particles, such as sulfur and carbon, is taking place.

Concurrently, an auxiliary fuel is directed controllably through the auxiliary fuel conduit 92 and discharges through the plurality of fuel channels 102 toward the flame envelope 66 in such a way that all or at least a major portion of the auxiliary fuel is directed toward peripheral zone 68 surrounding central reaction zone 64 of flame envelope 66. Also, concurrently, a second oxidizing gas, preferably pure oxygen or oxygen-enriched air, is directed controllably along a second oxidizing gas conduit 80 and discharges through the plurality of channels 108 toward the peripheral zone 68 of flame envelope 66. The auxiliary fuel and the second oxidizing gas mix to create an auxiliary peripheral zone 68 surrounding the central reaction zone 64 in the flash burner flame envelope 66.

When the auxiliary fuel and the second oxidizing gas are ignited, the auxiliary peripheral zone 68 heats and ignites the solid particles carried by the first auxiliary gas within the central reaction zone 64. When the particles are ignited, substantial heat is released by the exothermic oxidation reactions of the combustible components of the particles with the first oxidizing gas. The auxiliary peripheral zone 68, which surrounds the central reaction zone 64, insulates the central reaction zone and thereby reduces or completely eliminates the heat losses from the central reaction zone to the furnace interior.

The flame envelope is structured so that additional heat can be transferred to the central reaction zone 64 as conditions warrant. By increasing the oxygen content or quantity of the second oxidizing gas supply, the temperature of the outer auxiliary peripheral zone 68 is increased, thereby creating a temperature gradient between the inner and outer portion so that heat transfer to the central reaction zone 64 can be accomplished.

Optionally, when the second preferred embodiment of the flash burner is used to improve control over the atomizing and oxidizing of solid particles, a part of the oxidizing gas may be delivered separately as a third oxidizing gas from the third auxiliary gas conduit 222 and introduced through the tertiary auxiliary gas nozzle 124 into the main burner conduit 172 and further directed toward central reaction zone 64. The amount of first oxidizing gas needed to oxidize the stream of solid particles inside the central reaction zone 64 correspondingly may be reduced. This option, which can be used to vary the properties of the flame envelope, particularly the temperature of the central reaction zone 64, increases the flexibility of the smelting furnace.

During the smelting process, the temperature and shape of the flash flame envelope can be changed to control the combustion products and the heat transfer properties within the furnace by varying the quantities and routes of the fuel and oxidizing gases. The amount of heat given off from the burner is directly related to the amount of hydrocarbon fuel delivered to it. The concentration of oxygen and nitrogen in each oxidizing gas can be different. For example, pure oxygen can be used as the first oxidizing gas, oxygen enriched air as the second oxidizing gas, and air as the third oxidizing gas. By controlling the ratio of fuel to total oxygen, the stoichiometric ratio at which complete combustion occurs may be maintained as described. Furthermore, at any given fuel to total oxygen ratio, the temperature of the flame may be increased by increasing the oxygen concentration of the oxidizing gas or by increasing the portion of oxygen being delivered with oxidizing gas having higher oxygen content. These variables can also be adjusted to satisfy the heating requirements of the furnace with minimum operating costs.

Although this invention has been disclosed with fuel, oxygen, and air being supplied through particular conduits, it should be noted that the fuel and oxidizing gas supplies may be interchanged and the smelting furnace will still be able to function.

As described above, the smelting process and apparatus may also be used for flash smelting of particles other than copper concentrates. For example, incineration of hazardous wastes, such as used pot lining from the aluminum industry, produces a significant amount of carbon contaminated by hazardous organic and nonorganic components. However, the used pot lining of aluminum refining furnaces may be ground and further incinerated by the flash smelting method and apparatus described in this invention.

Another candidate for flash smelting is chopped lead-contaminated rubber from lead battery cases. The ability of the invention's flash burner to transfer a substantial amount of heat from the auxiliary peripheral zone 68 to the central reaction zone 64 allows the flash smelting of material that is not suitable for conventional flash smelting methods utilizing conventional flash burners. It should be understood that many other materials may become suitable for flash smelting with the use of the described flash burner and in accordance with the described flash smelting method.

For some smelting processes, in particular those processes that smelt carbon-containing particles, the residence time of particles in a conventional flash smelting flame is too short to accomplish complete melting. The present invention's ability to transfer heat from the auxiliary peripheral zone 68 to the central reaction zone 64 helps alleviate this problem. Furthermore, the present invention can complete the melting of such particles by employing an additional oxidation step that directs an additional oxidizing gas stream to bubble through the molten pool by the optional oxidizing gas injection means 164 as shown in FIG. 3. The additional oxidizing gas, such as air, oxygen, or oxygen-enriched air, can be also directed toward the molten bath surface through oxidizing gas injection means 36 as shown in FIG. 1.

Additional material may also be introduced into the flash furnace 10 through the charging opening 22. Charging opening 22 may be used to charge material similar to the ore particles or to decontaminate other materials in the flash furnace 10. Fluxing material may be mixed with solid particles and introduced into the flash furnace 10 through the flash burner 12, charging opening 22, or a dedicated charging opening not shown in FIG. 1.

While this invention is described in detail with particular reference to the preferred embodiments thereof, it will be understood that variations and modifications can be effected within the scope and spirit of the invention as previously set forth and as defined in the claims.

What is claimed is:

1. A method for improving the control and efficiency of a combustion reaction in a flash smelting furnace, comprising the steps of:

a. mixing a first oxidizing gas having a first oxygen concentration with solid particles consisting of at least one combustible component and at least one incombustible component;

b. directing said mixture of solid particles and oxidizing gas into a combustion chamber of said flash smelting furnace;

c. burning said mixture of solid particles and oxidizing gas in a first flame portion to provide for the heat release capable of converting at least part of said particles into liquid droplets;

d. directing an auxiliary fuel into said combustion chamber to surround said first flame portion;

e. directing a second oxidizing gas having a second oxygen concentration into said combustion chamber to surround said first flame portion and mix with said auxiliary fuel;

f. burning said auxiliary fuel and said second oxidizing gas to create a second flame portion surrounding said first flame portion; and g. controlling the flow of said first and second oxidizing gases and said auxiliary fuel to provide a temperature gradient between said first flame portion and said second flame portion for maintaining a desired temperature of said particles during smelting.

2. The method of claim 1, which further includes the steps of:

a. directing a third oxidizing gas having a third oxygen concentration into said first flame portion in said combustion chamber; and b. controlling the flow of said third oxidizing gas to maintain a desired temperature in the said first flame portion.

3. The method of claim 1, which further includes the steps of:

a. collecting a residue produced by the smelting of said particles inside said furnace in a furnace residue collecting volume; and b. directing a fourth oxidizing gas having a fourth oxygen concentration toward said furnace residue collecting volume to further oxidize said residue.

4. The method of claim 1, which further comprises the steps of:

a. collecting a residue produced by the smelting of said particles inside said furnace in a furnace residue collecting volume; and b. introducing fluxing materials into said residue.

5. The method of claim 1, which further includes the step of introducing fluxing material into said mixture of solid particles and oxidizing gas.

6. A method of claim 1, which further includes the steps of:

a. collecting a residue produced by the smelting of said particles; and b. introducing solid material into said residue through an opening in said furnace wall.

7. The method of claim 2, wherein at least one of said oxidizing gases is selected from the group consisting of pure oxygen, air, and oxygen-enriched air.

8. The method of claim 3 wherein at least one of said oxidizing gases selected from the group consisting of pure oxygen, air and oxygen-enriched air.

9. The method of claim 1, wherein at least one of the combustible components of said solid particles is carbon.

10. The method of claim 1, wherein at least one of the combustible components of said solid particles is sulfur.

11. The method of claim 1, which further includes the step of controlling the ratio of the amount of total combustible material to total oxygen introduced into said combustion chamber.

12. The method of claim 1, wherein said particles contain at least one metallic component.

13. The method of claim 12, wherein said metallic component is copper.

14. A method for improving the control and efficiency of a combustion reaction in a flash smelting furnace, comprising the steps of:

a. mixing a first oxidizing gas having a first oxygen concentration with solid particles consisting of at least one combustible component and at least one incombustible component;

b. directing said mixture of solid particles and oxidizing gas into a combustion chamber of said flash smelting furnace;

c. burning said mixture of solid particles and oxidizing gas in a first flame portion to provide for the smelting of said solid particles;

d. directing an auxiliary fuel into said combustion chamber to surround said first flame portion;

e. directing a second oxidizing gas having a second oxygen concentration into said combustion chamber to surround said first flame portion and mix with said auxiliary fuel;

f. burning said auxiliary fuel and said second oxidizing gas to create a second flame portion surrounding said first flame portion;

g. directing a third oxidizing gas having a third oxygen concentration into said first flame portion in said combustion chamber; and h. controlling the flow of said first, second, and third oxidizing gases and said auxiliary fuel to provide a temperature gradient between said first flame portion and said second flame portion for maintaining a desired temperature of said particles during smelting.

15. A flash smelting apparatus for the treatment of solid particles having at least one combustible component and at least one incombustible component which comprises:

a. a combustion chamber receivably attached to a burner;

b. first means for separately introducing said particles to said burner;

c. second means for separately introducing a first oxidizing gas to said burner, said first oxidizing gas mixing with said particles within said burner to create a first flame portion within the combustion chamber;

d. third means for separately introducing an auxiliary fuel preferably through a plurality of holes in said burner such that said auxiliary fuel surrounds said first flame portion in said combustion chamber; and e. fourth means for separately introducing a second oxidizing gas preferably through a plurality of holes in said burner such that said second oxidizing and said auxiliary fuel mix within said combustion chamber to create a second flame portion that surrounds said first flame portion.

16. The apparatus of claim 15, which further comprises means for separately directing a third oxidizing gas having a given oxygen concentration into said burner such that said third oxidizing gas mixes with said particles and said first oxidizing gas in said first flame portion.

17. The apparatus of claim 15, which further comprises:

a. means for collecting a residue created by the combustion of said particles in said combustion chamber; and b. means for separately directing a fourth oxidizing gas having a given oxygen concentration toward said residue.

18. The apparatus of claim 15, which further comprises means for introducing fluxing material into said first flame portion.

19. The apparatus of claim 15, which further comprises:

a. means for collecting a residue created by the combustion of said particles in said combustion chamber; and b. means for introducing fluxing material into said residue.

20. The apparatus of claim 15, which further comprises:

a. means for collecting a residue created by the combustion of said particles in said combustion chamber; and b. means for introducing solid material into said residue.

21. The apparatus of claim 15, which further comprises means for controlling the flow rate of said particles, said first and second oxidizing gases, and said auxiliary fuel.

22. A flash smelting apparatus for the treatment of solid particles having at least one combustible component and at least one incombustible component which comprises:

a. a combustion chamber receivably attached to a burner;

b. first means for separately introducing said particles to said burner;

c. second means for separately introducing a first oxidizing gas to said burner, said first oxidizing gas mixing with said particles within said burner to create a first flame portion within the combustion chamber;

d. third means for separately introducing an auxiliary fuel preferably through a plurality of holes in said burner such that said auxiliary fuel surrounds said first flame portion in said combustion chamber;

e. fourth means for separately introducing a second oxidizing gas preferably through a plurality of holes in said burner such that said second oxidizing gas and said auxiliary fuel mix within said combustion chamber to create a second flame portion that surrounds said first flame portion; and f. fifth means for separately introducing a third oxidizing gas preferably through a plurality of holes in said burner such that said third oxidizing gas mixes within said particles and said first oxidizing gas in said first flame portion.

* * * * *